US010421633B2

(12) United States Patent
Chen

(10) Patent No.: US 10,421,633 B2
(45) Date of Patent: Sep. 24, 2019

(54) METHOD FOR ARRANGING A MATERIAL WEB ON A CORE

(71) Applicant: Confidex OY, Tampere (FI)

(72) Inventor: Alvin Chen, Guangzhou (CN)

(73) Assignee: Confidex OY, Tampere (FI)

( * ) Notice: Subject to any disclaimer, the term of this patent is extended or adjusted under 35 U.S.C. 154(b) by 100 days.

(21) Appl. No.: 15/484,915

(22) Filed: Apr. 11, 2017

(65) Prior Publication Data

US 2017/0297850 A1 Oct. 19, 2017

(30) Foreign Application Priority Data

Apr. 14, 2016 (CN) ..... 2016 1 0232556

(51) Int. Cl.
*B65H 19/28* (2006.01)

(52) U.S. Cl.
CPC ..... *B65H 19/28* (2013.01); *B65H 2701/1244* (2013.01); *B65H 2701/194* (2013.01); *B65H 2701/1936* (2013.01); *B65H 2701/1942* (2013.01)

(58) Field of Classification Search
CPC ..... B65H 19/28; B65H 2701/1244; B65H 2701/1936; B65H 2701/194; B65H 2701/1942
See application file for complete search history.

(56) References Cited

U.S. PATENT DOCUMENTS 4,614,362 A * 9/1986 Breen ..... B41L 1/22 283/58
5,840,143 A * 11/1998 Swanson ..... B42D 25/00 156/256
5,947,408 A * 9/1999 Miyake ..... B65H 16/08 242/562
7,264,194 B2 * 9/2007 Gassner ..... B65H 19/102 242/555.3
7,971,336 B2 * 7/2011 Hanhikorpi ..... G06K 19/07718 29/592.1
8,366,035 B2 * 2/2013 Kling ..... B65H 26/00 242/563
2003/0106629 A1 * 6/2003 Manteufel ..... B31F 5/06 156/157
2003/0227528 A1 * 12/2003 Hohberger ..... B41J 3/4075 347/104
2005/0000842 A1 * 1/2005 Timmerman ..... B26D 5/32 206/449
2005/0006520 A1 * 1/2005 Gassner ..... B65H 19/102 242/555.3
2005/0155714 A1 * 7/2005 Adams ..... B65H 19/10 156/443
2006/0191426 A1 * 8/2006 Timmerman ..... B26D 5/32 101/24

(Continued)

*Primary Examiner* — Michael E Gallion
(74) *Attorney, Agent, or Firm* — Jeffrey T. Placker; Holland & Knight LLP

(57) ABSTRACT

A method for arranging a material web on a core. The method comprises providing a sheet of material, arranging the sheet on the core such that a first end of said sheet is not attached but loose from the core, arranging a first end of the material web between the core and the first end of the sheet, and reeling and tightening the rest of the material web on the core, the first end of the material web locating between the core and the first end of the sheet during said reeling and tightening.

17 Claims, 1 Drawing Sheet

(56) References Cited

U.S. PATENT DOCUMENTS

| | | | | |
|---|---|---|---|---|
| 2007/0102552 | A1* | 5/2007 | Gambini | B65H 18/28<br>242/160.1 |
| 2008/0149757 | A1* | 6/2008 | Tiitta | B65H 19/18<br>242/532.3 |
| 2013/0240657 | A1* | 9/2013 | Kuchar | B65H 23/022<br>242/418 |
| 2015/0000489 | A1* | 1/2015 | Koike | B65H 35/06<br>83/73 |

* cited by examiner

METHOD FOR ARRANGING A MATERIAL WEB ON A CORE

RELATED APPLICATIONS

This application claims the benefit of Chinese Patent Application No. 201610232556.2, filed on Apr. 14, 2016, the contents of which is incorporated by reference.

BACKGROUND

The invention relates to a method for arranging a material web on a core.

Various tickets, such as tickets for public transportation, movie tickets etc., are arranged in a ticket web from which individual tickets are disconnected when needed.

The ticket web is reeled up or coiled on a core, and thus created reel of ticket web is arrangeable in a ticket machine that is used for dispensing the individual tickets.

The first ticket is attached to the core by glue or double sided tape, or the core has a groove on its periphery and the first ticket is bent in the groove.

A problem with known reels of ticket web is that the first ticket may cause a jamming of the ticket machine due to glue residues or bent form thereof.

The same problem may also concern labels, stickers etc. which are reeled as a material web to a reel and dispensed by a dispenser.

BRIEF DESCRIPTION

Viewed from a first aspect, there can be a method for arranging a material web on a core, the method comprising: providing a sheet of material, arranging the sheet on the core such that a first end of said sheet is not attached but loose from the core, arranging a first end of the material web between the core and the first end of the sheet, and reeling and tightening the rest of the material web on the core, the first end of the material web locating between the core and the first end of the sheet during said reeling and tightening.

Thereby a reel of material web not jamming a dispensing machine may be achieved.

Inventive embodiments are also disclosed in other claims, the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1A:
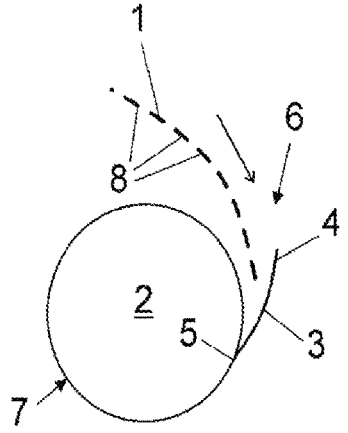
FIGS. 1*a* and 1*b* are schematic side views of a method according to the invention in partial cross-section.
Figure 1B:
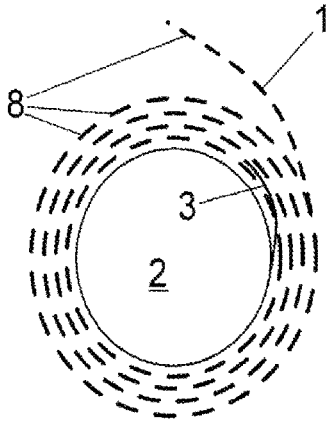

FIGS. 1*a* and 1*b* are schematic side views of a method according to the invention in partial cross-section.

The method for arranging a material web 1 on a core 2 comprises the following steps:

providing a sheet 3 of material, arranging the sheet 3 on the core 2 such that a first end 4 of said sheet is not attached but loose from the core 2, arranging a first end 6 of the material web between the core 2 and the first end 4 of the sheet, and reeling and tightening the rest of the material web 1 on the core 2, the first end 6 of the material web locating between the core 2 and the first end 4 of the sheet during said reeling and tightening.

The material web 1 is here a ticket web that comprises plurality of tickets 8, such as RFID tickets, arranged consecutively and attached detachably to each other. The material web 1 may comprise easily disconnectable sections between consecutive tickets, such as perforated sections.

In an embodiment, the first end 6 of the ticket web is the $1^{st}$ ticket in the ticket web.

In another embodiment, the material web 1 is a label web comprising plurality of labels arranged consecutively and attached detachably to each other.

In another embodiment, the material web 1 is a sticker web comprising plurality of stickers arranged consecutively and attached detachably to each other.

Figure 3:
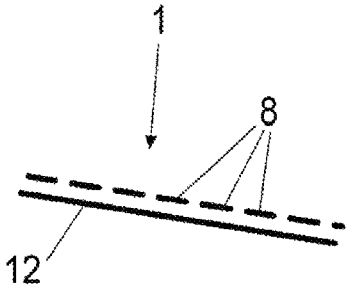
FIG. 3 is a schematic side view of an embodiment of a material web.

In still another embodiment, the material web 1 comprises a continuous support layer 12 (shown in FIG. 3) onto which the tickets, labels and/or stickers are attached by e.g. an adhesive.

According to an idea, the material web 1 comprises only consecutively arranged tickets, labels, and/or stickers.

According to another idea, the material web 1 comprises two or even more rows comprising consecutively arranged of tickets, labels and/or stickers, said rows being arranged parallel.

In an embodiment, the ticket, label and/or sticker in the material web 1 comprises an RFID tag.

In an embodiment, the ticket, label and/or sticker in the material web 1 comprises a Wlan (wireless local area network) transponder.

In an embodiment, the ticket, label and/or sticker in the material web 1 comprises an ANT+ transponder.

In an embodiment, the ticket, label and/or sticker in the material web 1 comprises a Dash7 transponder.

In an embodiment, the ticket, label and/or sticker in the material web 1 comprises an UWB (Ultra Wideband) transponder.

In an embodiment, the ticket, label and/or sticker in the material web 1 comprises a LoRaWAN (low power wide area network) transponder.

In an embodiment, the ticket, label and/or sticker in the material web 1 comprises a Zigbee transponder.

In an embodiment, the ticket, label and/or sticker in the material web 1 comprises a Z-Wave transponder.

In an embodiment, the ticket, label and/or sticker in the material web 1 comprises a Bluetooth transponder.

However, it is to be noted that the ticket, label or sticker may also be a "dummy" item without any transponder.

In an embodiment, the core 2 is a cylindrical object that comprises a periphery surface 7. The core 2 or at least the periphery surface 7 may be manufactured from e.g. paper, paperboard, cardboard, wood, plastic, metal or any other material or material composition.

In an embodiment, the sheet 3 of material is made of paper, paperboard, cardboard, plastic, metal or any other bendable material or material composition.

In an embodiment, the sheet 3 is manufactured separately from the core 2 and then attached to the core 2 e.g. by glue or mechanical means, such as staple(s).

In another embodiment, the sheet 3 is manufactured as an integrated element of the core 2. This embodiment can be carried out e.g. by moulding the core 2 and the sheet 3 using a suitable plastic material, or machining or shaving a section of the periphery surface 7 of core into the sheet 3, without detaching the sheet 3 from the core 2.

In an embodiment, the length of the sheet 3 may be 5 mm-500 mm.

In the embodiment shown in FIGS. 1*a*, 1*b*, the first end of the material web 6 between the periphery 7 of the core and the sheet 3. An advantage is that a strong friction may be provided to hold the material web 1, and the material web 1 will thus not move relatively to the core 2 under influence of external forces.

The material web 1 is arranged between the core 2 and the material web 1 without using any chemical or physical fixation means between the sheet and the material web and between the core and the material web.

Following the arranging the first end 6 of the material web between the core 2 and the first end 4 of the sheet, the rest of the material web 1 is coiled or reeled around the core 2 and over the sheet 3 by using suitable tensioning. The material web 1 reeled over the sheet 3 presses the first end 6 of material web against the core 2 and thus the material web 1 places itself on the core 2.

When the material web 1 is in use, e.g. arranged in a ticket machine (not shown), the first ticket 8 arranged between the core 2 and the first end 4 of the sheet is easily released form the core without any risk for jamming the ticket machine.

Figure 2A:
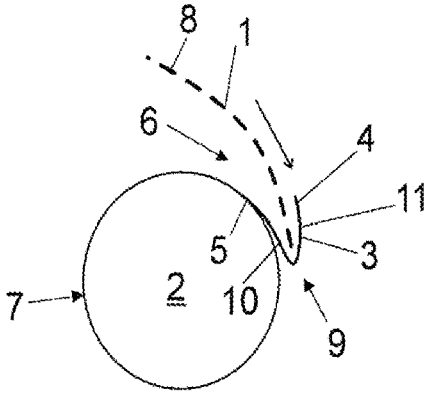
FIGS. 2*a* and 2*b* are schematic side views of another method according to the invention in partial cross-section.
Figure 2B:
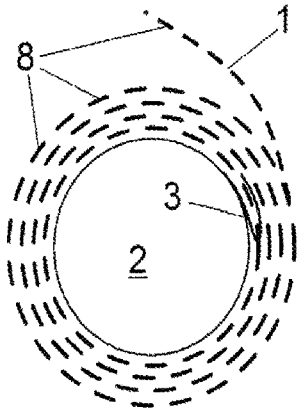

FIGS. 2*a* and 2*b* are schematic side views of another method according to the invention in partial cross-section. This method may comprise all the features disclosed above in, but now the method comprises providing the sheet 3 with a fold 9, and arranging the first end 6 of the material web in said fold 9 between sections 10, 11 of the folded sheet. In other words, the first end 6 of material web lies between folded sheet 3. Thus, it is made a layered structure where first layer is first one 10 of the sections that lies against the periphery surface 7 of the core, second layer is the first end 6 of material web, and the third layer is second one 11 of the sections. An advantage is that even a stronger friction may be provided to hold the material web 1.

The fold 9 may be provided prior to arranging the sheet 3 on the core 2, or alternatively, only just the sheet 3 has been arranged on the core 2.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 material web
2 core
3 sheet
4 1$^{st}$ end of sheet
5 2$^{nd}$ end of sheet
6 1$^{st}$ end of material web
7 periphery surface of core
8 ticket
9 fold
10, 11 section of folded sheet
12 support layer

The invention claimed is:

1. A method for arranging a material web on a core, the method comprising:

providing a sheet of material, the sheet of material including a fold, arranging the sheet on the core such that a first end of said sheet is not attached but loose from the core, arranging a first end of the material web between the core and the first end of the sheet, including arranging the first end of the material web in the fold between sections of the folded sheet, and reeling and tightening the rest of the material web on the core, the first end of the material web locating between the sections of the folded sheet during said reeling and tightening.

2. The method as claimed in claim 1, comprising arranging the first end of the material web between said core and the sheet.

3. The method as claimed in claim 1, being free of chemical or physical fixation means between the sheet and the material web and between the core and the material web.

4. The method as claimed in claim 1, comprising providing the sheet of material manufactured separately from the core, and attaching the sheet of material to the core.

5. The method as claimed in claim 1, comprising manufacturing the sheet as an integrated element of the core.

6. The method as claimed in claim 1, wherein the material web comprises RFID tags.

7. The method as claimed in claim 1, wherein the material web comprises Wlan (wire-less local area network) transponders.

8. The method as claimed in claim 1, wherein the material web comprises ANT+transponders.

9. The method as claimed in claim 1, wherein the material web comprises Dash? transponders.

10. The method as claimed in claim 1, wherein the material web comprises UWB (UltraWideband) transponders.

11. The method as claimed in claim 1, wherein the material web comprises LoRaWAN (low power wide area network) transponders.

12. The method as claimed in claim 1, wherein the material web comprises Zigbee transponders.

13. The method as claimed in claim 1, wherein the material web comprises Z-Wave transponders.

14. The method as claimed in claim 1, wherein the material web comprises Bluetooth transponders.

15. The method as claimed in claim 1, wherein the material web is a ticket web.

16. The method as claimed in claim 1, wherein the material web is a label web.

17. The method as claimed in claim 1, wherein the material web is a sticker web.

* * * * *